US008997283B2

(12) United States Patent
Bourgraf, Jr. et al.

(10) Patent No.: US 8,997,283 B2
(45) Date of Patent: Apr. 7, 2015

(54) WORK SURFACE EXTENSIONS FOR EMBALMING TABLES AND EMBALMING TABLES INCLUDING THE SAME

(75) Inventors: Elroy Bourgraf, Jr., Maineville, OH (US); Jon Carl Brunke, Wilmington, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 0 days.

(21) Appl. No.: 14/352,329

(22) PCT Filed: Oct. 20, 2011

(86) PCT No.: PCT/US2011/057098

§ 371 (c)(1),
(2), (4) Date: May 8, 2014

(87) PCT Pub. No.: WO2013/058753

PCT Pub. Date: Apr. 25, 2013

(65) Prior Publication Data

US 2014/0259416 A1 Sep. 18, 2014

(51) Int. Cl.
*A47B 7/00* (2006.01)
*A61G 13/00* (2006.01)

(52) U.S. Cl.
CPC ..... *A61G 13/0027* (2013.01)

(58) Field of Classification Search
CPC ..... A61G 13/0027
USPC ..... 5/207–208, 613, 632, 657
See application file for complete search history.

(56) References Cited

U.S. PATENT DOCUMENTS

| | | | | |
|---|---|---|---|---|
| 1,449,747 | A * | 3/1923 | Fuchs | 5/208 |
| 4,418,900 | A * | 12/1983 | Ricke | 5/632 |
| 4,669,136 | A | 6/1987 | Waters et al. | |
| 5,179,744 | A | 1/1993 | Foster et al. | |
| 5,244,433 | A * | 9/1993 | Utterback | 454/49 |
| 5,745,936 | A | 5/1998 | Van McCutchen et al. | |
| 6,108,840 | A | 8/2000 | Heimbrock et al. | |
| 2005/0160530 | A1 * | 7/2005 | Taguchi et al. | 5/618 |
| 2006/0059621 | A1 | 3/2006 | Poulos et al. | |

(Continued)

OTHER PUBLICATIONS

Search Report for International Application No. PCT/US2011/057098 dated Jul. 2, 2012.

(Continued)

*Primary Examiner* — Robert G Santos
*Assistant Examiner* — Myles Throop
(74) *Attorney, Agent, or Firm* — Dinsmore & Shohl LLP

(57) ABSTRACT

In one embodiment, a work surface extension for an embalming table may include a sheet member, one or more spar members, at least one stiffening member, and a clamping member. The at least one stiffening member may include a table accepting opening partially formed by a table datum feature, a strut member that extends laterally from the table accepting opening in a first direction, and a sheet contacting surface the extends laterally from the table accepting opening in a second direction. The table datum feature and the processing surface of the sheet member can be aligned at an extension alignment angle that is acute. The clamping member can be rotatably engaged with the at least one stiffening member. The clamping member may include a table engagement feature that is biased to at least partially enclose the table accepting opening of the at least one stiffening member.

24 Claims, 4 Drawing Sheets

(56) References Cited

U.S. PATENT DOCUMENTS

Figure 1:
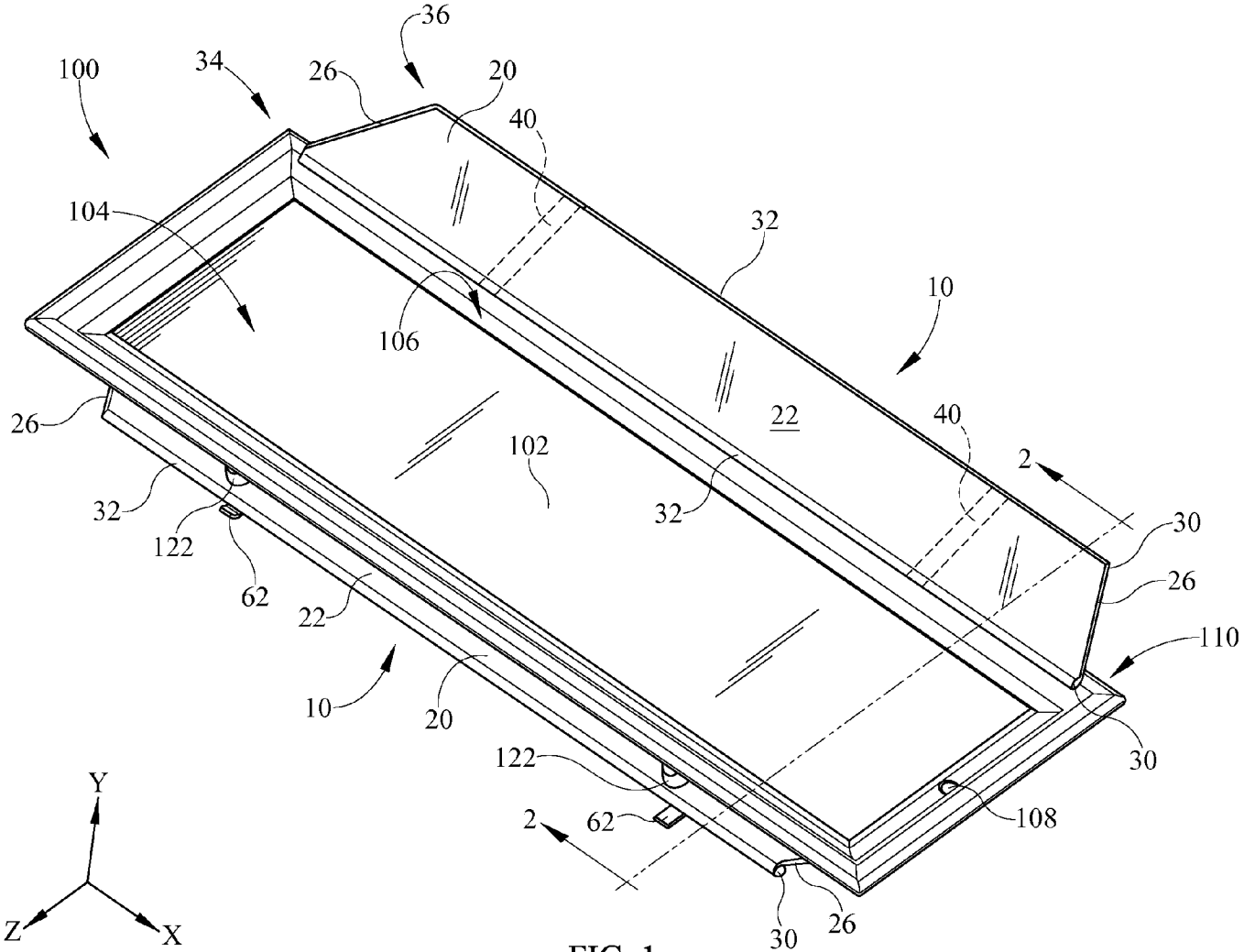

2006/0195984 A1* 9/2006 HakamiuN et al. ..... 5/430
2014/0215717 A1* 8/2014 Rigsby et al. ..... 5/613

OTHER PUBLICATIONS

Written Opinion for International Application No. PCT/US2011/057098 dated Apr. 22, 2014.

* cited by examiner

WORK SURFACE EXTENSIONS FOR EMBALMING TABLES AND EMBALMING TABLES INCLUDING THE SAME

The present specification generally relates to work surface extensions for embalming tables.

Human remains may be embalmed to forestall decomposition and to make the remains suitable for public display at a funeral. The embalming process can include the use of a variety of embalming chemicals that preserve, sanitize, and disinfect the remains. Embalming chemicals may include formaldehyde, glutaraldehyde, ethanol, humectants, wetting agents, and other solvents. Specifically, during the embalming process embalming chemicals can be injected into the human remains and organs may be removed from the remains. Accordingly, the embalming process may require the proper handling of various fluids and solids.

During the embalming process, the remains can be supported on an embalming table to control fluids during the embalming process. Exemplary embalming tables include the Model 101-H Hydraulic Operating Table, Model 102 Folding Operating Table, and The Model 103 Combination Operating Table, each of which are available from Ferno-Washington, Inc. of Wilmington, Ohio, U.S.A.

Recently the rate of obesity has increased, and the rate of obesity has further increased with age. Accordingly, obesity causes a large number of deaths annually. However, current embalming tables utilized by many funeral homes are inadequate to handle the remains of an obese person. Many of the embalming tables are not large enough to contain the remains of an obese person, and/or the fluids released during the embalming process. Moreover, funeral homes are commonly dwellings that have been converted for use as a funeral home. Such funeral homes commonly have small door openings and hallways with respect to embalming tables that are specifically created for use with the remains of an obese person.

Accordingly, a need exists for alternative work-surface extensions for embalming tables.

In one embodiment, a work surface extension for an embalming table may include a sheet member, one or more spar members, at least one stiffening member, and a clamping member. The sheet member can form a processing surface and a structural contact surface. The one or more spar members can be secured to the sheet member and in contact with the structural contact surface of the sheet member. The at least one stiffening member can be secured to the one or more spar members. The at least one stiffening member may include a table accepting opening partially formed by a table datum feature, a strut member that extends laterally from the table accepting opening in a first direction, and a sheet contacting surface the extends laterally from the table accepting opening in a second direction. The table datum feature and the processing surface of the sheet member can be aligned at an extension alignment angle such that the extension alignment angle is acute. The clamping member can be rotatably engaged with the at least one stiffening member. The clamping member may include a table engagement feature that is biased to at least partially enclose the table accepting opening of the at least one stiffening member.

In another embodiment an embalming assembly may include an embalming table and a work surface extension. The embalming table may include a work surface having an outer profile. The work surface extension may include a sheet member forming a processing surface and a structural contact surface, one or more spar members secured to the sheet member and in contact with the structural contact surface of the sheet member, at least one stiffening member secured to the one or more spar members, and a clamping member rotatably engaged with the at least one stiffening member. The at least one stiffening member may include a table accepting opening partially formed by a table datum feature. The clamping member may include a table engagement feature that is biased in a bias direction. The table datum feature of the at least one stiffening member can be in contact with and can be urged towards the work surface of the embalming table by the table engagement feature of the clamping member. The table engagement feature of the clamping member and the table accepting opening of the at least one stiffening member may cooperate to at least partially surround the outer profile of the embalming table.

These and additional features provided by the embodiments described herein will be more fully understood in view of the following detailed description, in conjunction with the drawings.

Figure 2A:
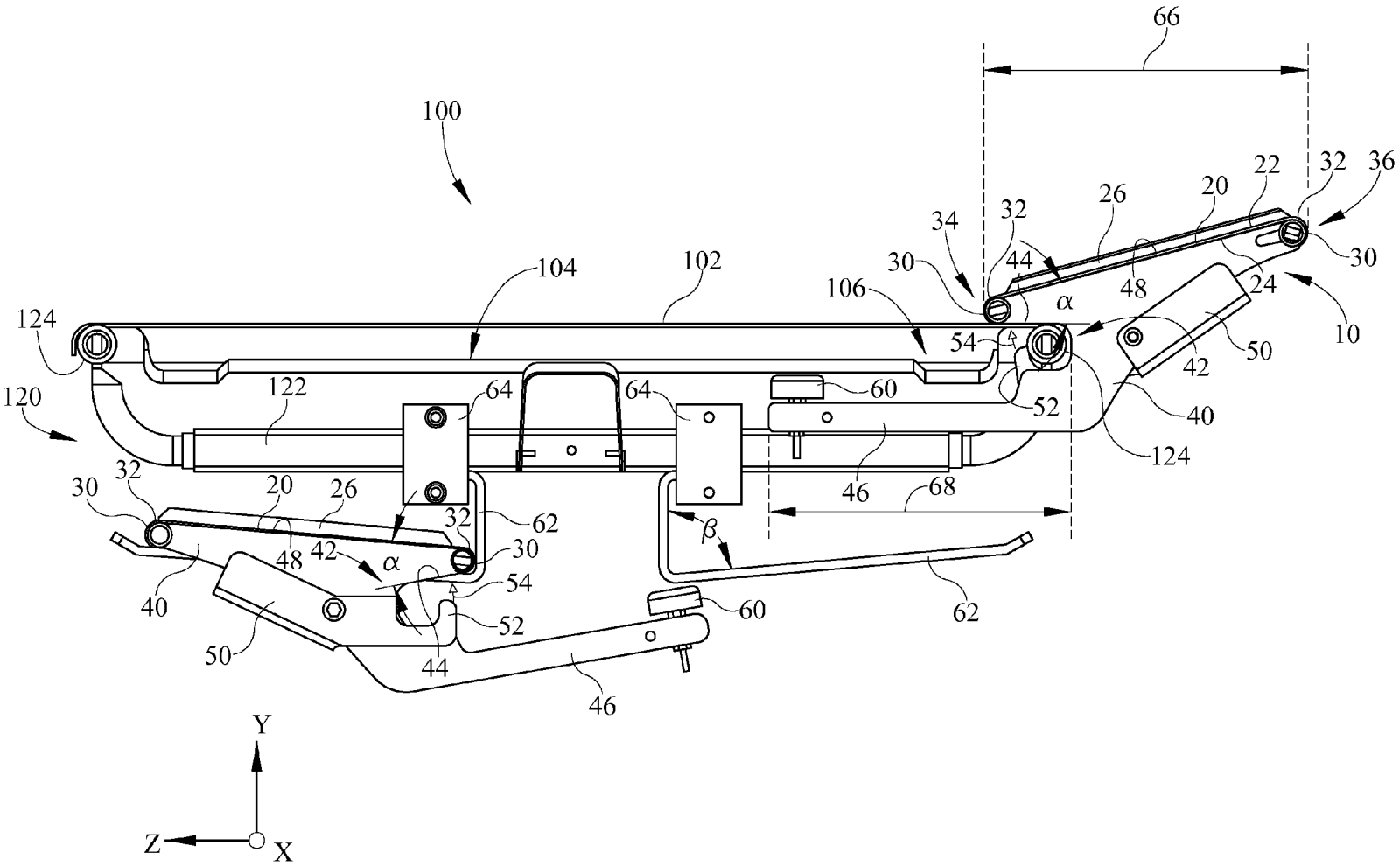
Figure 2B:
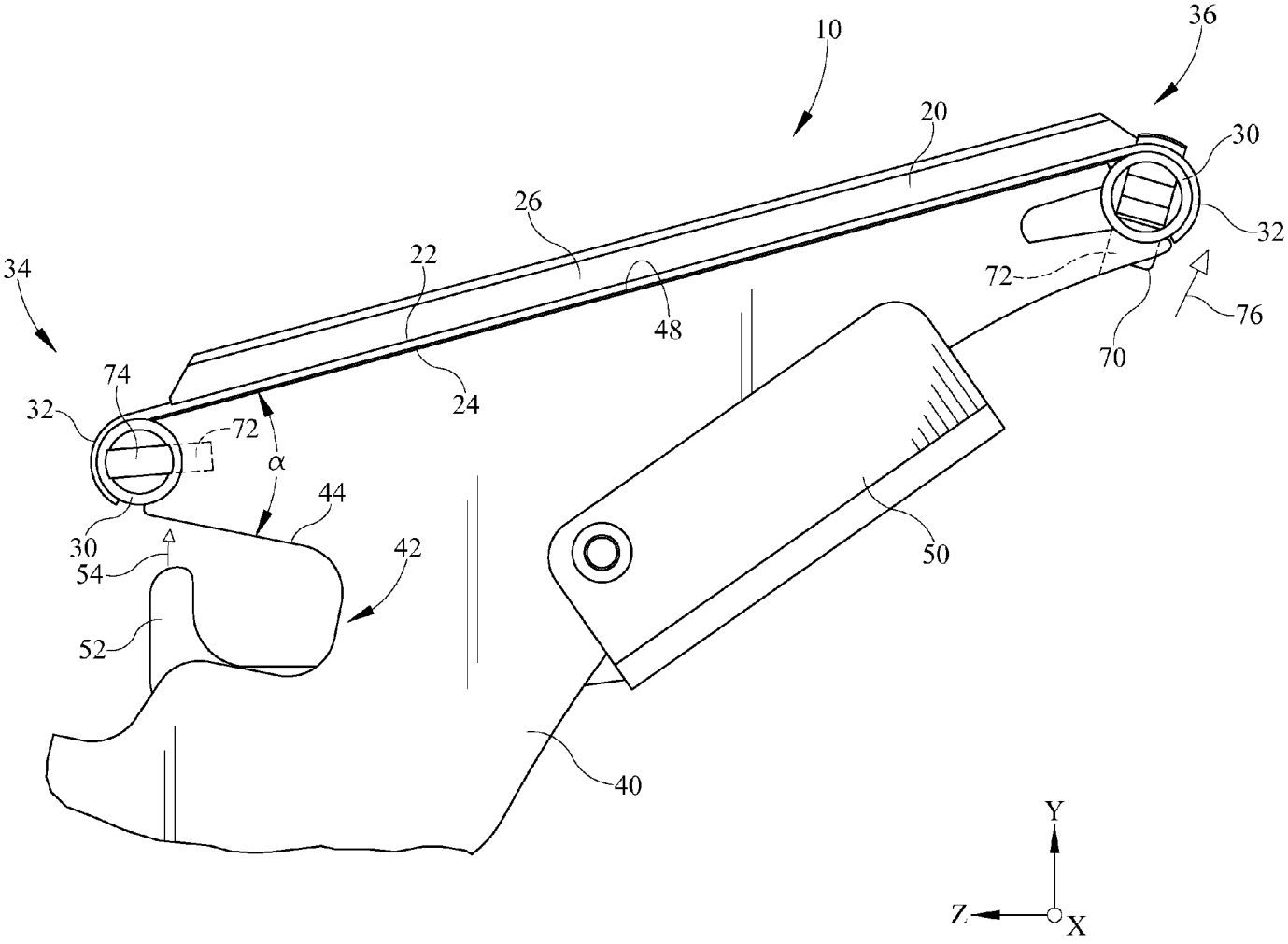
Figure 3:
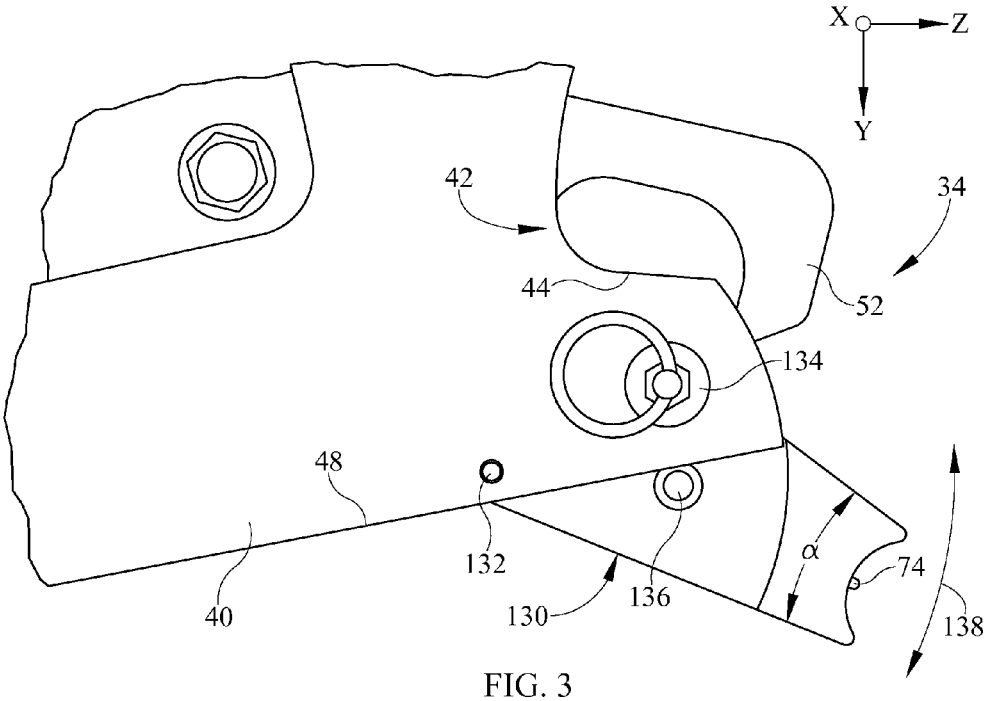
Figure 4:
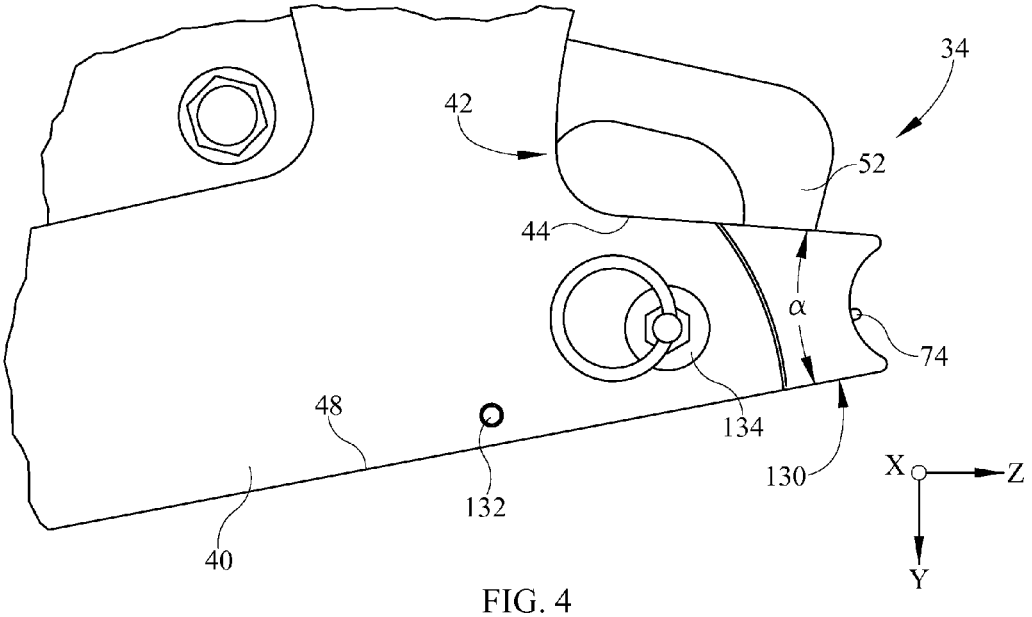

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

FIG. 1 schematically depicts a work surface extension according to one or more embodiments shown and described herein;

FIG. 2A schematically depicts a cross sectional view of a work surface extension along line 2-2 of FIG. 1 according to one or more embodiments shown and described herein;

FIG. 2B schematically depicts a cross sectional view of a work surface extension along line 2-2 of FIG. 1 according to one or more embodiments shown and described herein;

FIG. 3 schematically depicts a spar member according to one or more embodiments shown and described herein; and FIG. 4 schematically depicts a spar member according to one or more embodiments shown and described herein.

FIG. 2A generally depicts one embodiment of a work surface extension for extending the usable work surface of an embalming table. The work surface side extension generally comprises a sheet member, one or more spar members, at least one stiffening member secured to the one or more spar members, and a clamping member. Various embodiments of work surface extensions and the operation of work surface extensions will be described in more detail herein.

Referring collectively to FIGS. 1 and 2A, a work surface extension 10 for an embalming table 100 is schematically depicted. The work surface extension 10 comprises a sheet member 20 for adding usable surface area to the embalming table 100. The sheet member 20 forms a processing surface 22 and a structural contact surface 24. The sheet member 20 may be formed from any substantially rigid and chemically resistant material such as, for example, stainless steel or a durable chemically resistant plastic (i.e., a polymer resistant to degradation caused by embalming and/or bodily fluid).

Referring now to FIG. 2B, the sheet member 20 may comprise a shaped portion 32 for frictionally engaging with a spar member 30. Accordingly, the shaped portion 32 may be formed to interlock with the spar member 30. The shaped portion 32 can be formed at the table end 34 of the sheet member 20, the lateral end 36 of the sheet member 20, or both. It is noted that while the shaped portion 32 is depicted in FIG. 2B as a radius, the shaped portion 32 may be any shape suitable to interlock with a spar member 30 such as, for example, rectangular, angled, chamfered, and the like.

In further embodiments, the sheet member 20 may include one or more flanges 26 for containing fluids upon the processing surface 22 of the sheet member 20. Specifically, as depicted in FIG. 1, each of the lengthwise edges 38 of the sheet member 20 may be upturned to form a flange 26. To further assist with fluid containment, the lengthwise edges 38 of the sheet member 20 can be tapered laterally. For example, the distance between the lengthwise edges 38 can be reduced from the table end 34 of the sheet member towards the lateral end of the sheet member 20.

Referring collectively to FIGS. 2A and 2B, the work surface extension 10 comprises one or more spar members 30 for providing structural support along the lengthwise span of the work surface extension 10. The spar members 30 may be formed from any substantially rigid and chemically resistant material such as, for example, stainless steel or a durable chemically resistant plastic. It is noted that while the spar members 30 are depicted in FIGS. 2A and 2B as hollow circular tubes, the spar members 30 may be solid (e.g., rods) and/or hollow (e.g., tubes). However, tubing may be preferred for reduced weight and ease of handling. Furthermore, the spar members 30 can have any cross-sectional shape suitable to provide structural support such as, for example, square, rectangular, angled, circular, and the like.

The work surface extension 10 comprises at least one stiffening member 40 that provides lateral support for the work surface extension 10. The at least one stiffening member 40 may be formed from any substantially rigid and chemically resistant material such as, for example, stainless steel or a durable chemically resistant plastic. The at least one stiffening member 40 comprises a table accepting opening 42 for receiving an embalming table 100. Accordingly, the table accepting opening 42 can be contoured to substantially match a portion of the embalming table 100. For example, at least a portion of the table accepting opening 42 can interlock with the outer profile 110 of the embalming table 100.

The table accepting opening 42 of the stiffening member 40 is partially formed by a table datum feature 44 that aligns the stiffening member with the work surface 102 of the embalming table 100. The table datum feature 44 forms a surface that is configured to contact the embalming table 100 and align the processing surface 22 of the sheet member 20 to the work surface 102 of the embalming table 100. Accordingly, the processing surface 22 may provide additional work space to supplement the work surface 102 of the embalming table 100.

Referring to FIG. 2A, the at least one stiffening member 40 further comprises a strut member 46 for providing lateral support to the work surface extension 10. The strut member 46 extends laterally from the table accepting opening 42 of the at least one stiffening member 40 a strut length 68 in the positive z-direction. The at least one stiffening member 40 further comprises a sheet contacting surface 48 that extends laterally from the table accepting opening 42 of the at least one stiffening member 40, i.e., the sheet contacting surface 48 extends in a direction including a component substantially along the negative z-direction. Specifically, the z-component is a processing distance 66. In one embodiment, the processing distance 66 can be larger than the strut length. In embodiments where the sheet member 20 is substantially planar, the table datum feature 44 and the sheet contacting surface 48 may be aligned at an angle that is less than the extension alignment angle $\alpha$.

The work surface extension 10 comprises a clamping member 50 for providing a clamping force sufficient the hold the work surface extension 10 to the embalming table 100. The clamping member 50 comprises a table engagement feature 52 for clamping a portion of the embalming table 100. Accordingly, the table engagement feature 52 can be contoured to substantially match a portion of the embalming table 100. For example, at least a portion of the table engagement feature 52 can interlock with the outer profile 110 of the embalming table 100. A bias force (e.g., helical and/or torsion spring) is applied to clamping member 50 such that the table engagement feature 52 is biased towards a bias direction 54. The clamping member 50 may be formed from any substantially rigid and chemically resistant material such as, for example, stainless steel or a durable chemically resistant plastic.

In one embodiment, which is depicted in FIG. 2B, the work surface extension 10 comprises two spar members 30 frictionally engaged with the structural contact surface 24 of the sheet member 20. Specifically, the table end 34 and the lateral end 36 of the sheet member 20 comprise a shaped portion 32. Each shaped portion 32 is formed such that it partially surrounds a spar member 30. At least one stiffening member 40 can be secured to the spar members 30 such that the spar members 30 are clamped between then shaped portions 32 of the sheet member 20 and the at least one stiffening member 40. For example, the at least one stiffening member 40 can be sized such that the sheet member 20 applies compression that holds the spar members 30 to the at least one stiffening member 40. In some embodiments, the table end 34 and the lateral end 36 of the at least one stiffening member 40 can be recessed to accept a spar member 30. Accordingly, the shaped portions 32 of the sheet member 20 and the at least one stiffening member 40 can cooperate to at least partially enclose the spar members 30.

When the sheet member 20, the spar members 30 and the at least one stiffening member 40 are secured to one another, the sheet member 20 is supported by the at least one stiffening member 40. Specifically, the structural contact surface 24 of the sheet member 20 can be in contact with the sheet contacting surface 48 of the stiffening member 40. Furthermore, when so secured, the table datum feature 44 and the processing surface 22 of the sheet member 20 are aligned at the extension alignment angle $\alpha$. The extension alignment angle $\alpha$ is acute such as, for example, in one embodiment the alignment angle $\alpha$ is less than about 45°, or in another embodiment from about 5° to about 30°.

Referring back to FIG. 2B, in some embodiments each stiffening member 40 can be selectively rotatable. For example, the table end 34, the lateral end 36 of the at least one stiffening member 40, or both can include an orifice 72. The at least one stiffening member 40 can be releasably engaged with the spar members 30. Specifically, the spar member 30 at the table end 34 of the at least one stiffening member 40 can include a pin 74 and the spar member 30 at the lateral end 36 can include a biased attachment member 70 such as, for example, a detent and the like. When the sheet member 20, the spar members 30 and the at least one stiffening member 40 are secured to one another, the pin 74 and the biased attachment member 70 can be received by the orifices 72 such that twisting (i.e., rotation substantially about the y-axis) is mitigated.

When the biased attachment member 70 is actuated in the release direction 76, the biased attachment member 70 can be urged away from the orifice 72 to decouple the at least one stiffening member 40. When the stiffening member 40 is decoupled, the stiffening member 40 can be twisted to relieve the clamping force applied by the sheet member 20 upon the spar members 30 and the at least one stiffening member 40. Accordingly, the work surface extension 10 can be disassembled, e.g., for cleaning or storage. It is noted that, while twisting is mitigated in the embodiment depicted in FIG. 2B by a biased attachment member 70 and a pin 74 engaged with orifices in the 72 in the stiffening member 40, further selectively rotatable embodiments are contemplated. For example, the at least one stiffening member 40 can be engaged with an attachment member such as, for example, a pin, a detent, a bolt, an anchor, and the like at neither, both or one of the table end 34 and the lateral end 36. However, favorable utility may be found in an embodiment that mitigates twisting in order to prevent accidental disassembly.

Referring collectively to FIGS. 3 and 4, the stiffening member 40 may be rotatably coupled with a spar engagement member 130 for releasable engagement with one of the spar members 30 (FIGS. 2A and 2B). Referring to FIG. 3, the spar engagement member 130 may comprise a pivoting axis 132 and a locking member 134 that cooperates with a lock orifice 136 to selectively lock or release the spar engagement member 130. The pivoting axis 132 can be a pin or any other device suitable to rotatably couple the stiffening member 40 and the spar engagement member 130. When the spar engagement member 130 is released, depicted in FIG. 3, the spar engagement member 130 can rotate about the pivoting axis 132 and along the pivoting direction 138. Accordingly, the spar engagement member 130 can be released to facilitate assembly and disassembly of the embodiments described herein.

When the spar engagement member 130 is locked, as depicted in FIG. 4, the spar engagement member 130 can be fixed with respect to the stiffening member 40 to rigidly engage the stiffening member 40 with one or more of the spar members 30 (FIGS. 2A and 2B). The locking member 134 can be a pin that is biased along the x-axis to engage with the lock orifice 136. It is noted that the locking member 134 and/or the lock orifice 136 can be replaced with any device suitable to selectively lock and release the spar engagement member 130 with respect to the stiffening member 40. Furthermore it is noted that, while the spar engagement member 130 is depicted in FIGS. 3 and 4 at the table end 34 of the stiffening member 40, the stiffening member 40 may include multiple spar engagement members.

Referring again to FIG. 1, the work surface extension 10 can be coupled to the embalming table 100 to provide an extended working area. For example, the embalming table 100 may include a work surface 102. The work surface 102 may include an elevated center portion 104 and a fluid draining recess 106 formed therein that cooperate to manage the flow of fluids. Specifically, the elevated center portion 104 directs fluid towards the fluid draining recess 106, which collects fluid. The fluid draining 106 can be sloped to direct the collected fluid towards a drain 108 for disposal.

Referring back to FIG. 2A, the work surface 102 can be coupled to a support frame 120 that provides structural rigidity to the work surface 102. The support frame 120 may include one or more lateral support members 122 that are coupled to one or more lengthwise support members 124. In the embodiment depicted in FIG. 2B, the support frame 120 comprises two lateral support members 122 and two lengthwise support members 124 in a substantially rectangular configuration. Additionally, is noted that the support frame 120 can be coupled to a hydraulic system and a rolling chassis, which are not depicted in FIG. 2B. Furthermore, it is noted that, while the embodiments described herein are described with respect to a particular embalming table, the embodiments described herein may be utilized with any embalming table.

The clamping member 50 is rotatably engaged with the at least one stiffening member 40 to provide a clamping force sufficient to hold the work surface extension 10 substantially stationary with respect to the embalming table 100. For example, biased member can be biased in the bias direction 54 such that the table engagement feature 52 of the clamping member 50 is urged against the embalming table 100. For example, the outer profile 110 of the embalming table 100 may be partially enclosed by the table accepting opening 42 of the at least one stiffening member 40. The table datum feature 44 of the at least one stiffening member 40 can be in contact with the work surface 102 of the embalming table 100 and the lengthwise support member 124 of the embalming table 100 can be located within the table accepting opening 42 of the at least one stiffening member 40. The table engagement feature 52 of the clamping member 50 can be biased in the bias direction 54, such that the table datum feature 44 of the at least one stiffening member 40 can be in contact with the work surface 102 such that the table datum feature is urged towards the work surface 102 of the embalming table 100 and table engagement feature 52 of the clamping member 50 and the table accepting opening 42 of the at least one stiffening member 40 cooperate to at least partially surround the lengthwise support member 124 of the embalming table 100.

Furthermore, when the table engagement feature 52 of the clamping member 50 is actuated in a direction opposing the bias direction 54, the table engagement feature 52 of the clamping member 50 and the table accepting opening 42 of the at least one stiffening member 40 surround a smaller portion of the outer profile 110 of the embalming table 100. Specifically, when the bias force of the clamping member 50 is reduced the clamping member releases the embalming table 100, i.e., the clamping member 50 opens and the work surface extension 10 can be removed from the embalming table 100.

Further support for the work surface extension 10 can be provided by the strut member 46 that can extend laterally in the positive z-direction beneath the work surface 102 of the embalming table 100. When the outer profile 110 of the embalming table 100 is clamped by the clamping member 50, a table contacting member 60 can be placed in contact with the embalming table 100 to resist rotation about the x-axis when force is applied to the processing surface of the work surface extension 10. Accordingly, the table contacting member 60 can be formed from a material that has a higher coefficient of friction and that is more flexible than the embalming table such as, for example, an elastomer.

Referring back to FIG. 1, the work surface extension 10 can be optionally coupled to or removed from the outer profile 110 of the embalming table 100 by actuating the clamping member 50. When the work surface extension 10 is engaged with the embalming table 100, the shaped portion 32 at the table end of the work surface extension 10, can be disposed over the fluid draining recess 106 of the work surface 102. Accordingly, fluids bounded by the work surface extension 10 can flow into the fluid draining recess 106. The work surface extension 10 can also be stored beneath the work surface 102 of the embalming table 100.

In some embodiments, depicted in FIG. 2A, the embalming table 100 may comprise one or more bracket members 62 for storage of the work surface extension 10 when not engaged with the outer profile 110 of the embalming table 100. The bracket member 62 can be formed into a substantially "L" having a bracket angle β. The bracket angle β can be any angle suitable to secure a work surface extension 10 during transport (e.g., rolling of the embalming table 100) such as, for example, in one embodiment the bracket angle β can be acute. Each bracket member 62 can be coupled to the support frame 120 of the embalming table 100 via a coupling member 64.

It should now be understood that the embodiments described herein provide for the extension of the work surface of an embalming table. For example, the work surface extensions can be attached to an embalming table and/or removed from an embalming table through the actuation of a clamping member. The work surface extensions can be angled with respect to the work surface to cooperate with the drainage system of an embalming table and control the flow of fluids during the embalming process. Moreover, the side extensions may be used to hold the remains of an obese person that could not be accommodated by the embalming table absent the work surface extensions. Moreover, the embalming table can be provided with storage such that, when not in use, the work surface extensions can be stored beneath the embalming table. Thus, the embalming table can be easily moved from room to room.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Furthermore, it is noted that the embodiments described herein have been provided with a xyz coordinate system for clarity. Accordingly, the xyz coordinate system can be transformed into any other coordinate system without departing from the scope of the description. Moreover, directional terms such as lateral, lengthwise, and the like have been described with respect to the provided coordinate system and are not intended to be limiting. Specifically, lateral, as used herein, generally refers to a direction along the z-axis and lengthwise, as used herein, generally refers to a direction along the x-axis. Accordingly, any transformation of the coordinate system may also be applied to such terms without departing from the scope of the present disclosure.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

The invention claimed is:

1. A work surface extension for an embalming table, the work surface extension comprising:

a sheet member forming a processing surface and a structural contact surface;

one or more spar members secured to the sheet member and in contact with the structural contact surface of the sheet member;

at least one stiffening member secured to the one or more spar members, wherein the at least one stiffening member comprises a table accepting opening partially formed by a table datum feature, a strut member that extends laterally from the table accepting opening in a first direction, and a sheet contacting surface the extends laterally from the table accepting opening in a second direction, and wherein the table datum feature and the processing surface of the sheet member are aligned at an extension alignment angle such that the extension alignment angle is acute; and a clamping member rotatably engaged with the at least one stiffening member, wherein the clamping member comprises a table engagement feature that is biased to at least partially enclose the table accepting opening of the at least one stiffening member.

2. The work surface extension of claim 1, wherein the sheet member comprises one or more shaped portions formed at a table end of the sheet member, a lateral end of the sheet member, or both.

3. The work surface extension of claim 2, wherein the one or more shaped portions are interlocked with the one or more spar members.

4. The work surface extension of claim 3, wherein the one or more spar members are clamped between the one or more shaped portions of the sheet member and the at least one stiffening member.

5. The work surface extension of claim 4, wherein the at least one stiffening member is selectively rotatable.

6. The work surface extension of claim 5, wherein a first spar member of the one or more spar members is engaged with an orifice of the at least one stiffening member via a biased attachment member.

7. The work surface extension of claim 3, wherein the one or more shaped portions are a radius.

8. The work surface extension of claim 7, wherein the one or more spar members have a circular cross section.

9. The work surface extension of claim 1, wherein the sheet member comprises stainless steel.

10. The work surface extension of claim 1, wherein the sheet member comprises one or more flanges for containing fluid.

11. The work surface extension of claim 1, wherein the sheet member is tapered laterally.

12. The work surface extension of claim 1, wherein the one or more spar members are hollow.

13. The work surface extension of claim 1, wherein the at least one stiffening member comprises a durable chemically resistant plastic.

14. The work surface extension of claim 1, wherein the at least one stiffening member receives one of the one or more spar members in a recess formed in the at least one stiffening member.

15. The work surface extension of claim 1, wherein the extension alignment angle is less than about 45°.

16. The work surface extension of claim 1, wherein the at least one stiffening member is rotatably coupled with a spar engagement member.

17. An embalming assembly comprising:

an embalming table comprising a work surface having an outer profile; and a work surface extension comprising a sheet member forming a processing surface and a structural contact surface, one or more spar members secured to the sheet member and in contact with the structural contact surface of the sheet member, at least one stiffening member secured to the one or more spar members, and a clamping member rotatably engaged with the at least one stiffening member, wherein:

the at least one stiffening member comprises a table accepting opening partially formed by a table datum feature;

the clamping member comprises a table engagement feature that is biased in a bias direction;

the table datum feature of the at least one stiffening member is in contact with and is urged towards the work surface of the embalming table by the table engagement feature of the clamping member; and the table engagement feature of the clamping member and the table accepting opening of the at least one stiffening member cooperate to at least partially surround the outer profile of the embalming table.

18. The embalming assembly of claim 17, wherein the work surface of the embalming table is coupled to a support frame, and the table engagement feature of the clamping member and the table accepting opening of the at least one stiffening member cooperate to at least partially surround a portion of the support frame.

19. The embalming assembly of claim 17, wherein when the table engagement feature of the clamping member is actuated in a direction opposing the bias direction, the table engagement feature of the clamping member and the table accepting opening of the at least one stiffening member surround a smaller portion of the outer profile of the embalming table.

20. The embalming assembly of claim 17, wherein the at least one stiffening member comprises a strut member that extends laterally from the table accepting opening and a table contacting member coupled to the strut member and in contact with the embalming table.

21. The embalming assembly of claim 20, wherein the table contacting member comprises an elastomer.

22. The embalming assembly of claim 17, wherein the sheet member comprises a shaped portion formed at a table end of the sheet member, and the shaped portion is interlocked with one of the one or more spar members.

23. The work surface extension of claim 22, wherein the embalming table comprises a fluid draining recess, and the shaped portion of the sheet member is located over the fluid draining recess.

24. The embalming assembly of claim 17, wherein the embalming table is coupled to one or more bracket members for storing the work surface extension.

* * * * *